US008418768B2

(12) United States Patent
Manopinives et al.

(10) Patent No.: US 8,418,768 B2
(45) Date of Patent: Apr. 16, 2013

(54) BYPASS GASLIFT SYSTEM, APPARATUS, AND METHOD FOR PRODUCING A MULTIPLE ZONES WELL

(75) Inventors: Somchai Manopinives, Bangkok (TH); Pramote Phloi-montri, Bangkok (TH); Suraphong Iamchula, Bangkok (TH); Kanit Sangwongwanich, Bangkok (TH); Pairoj Rangponsumrit, Bangkok (TH); Suwan Umnuayponwiwat, Bangkok (TH); Thamarat Pairintra, Bangkok (TH); Pattana Pittrapan, Bangkok (TH); Suwin Sompopsart, Bangkok (TH); Wararit Toempromraj, Bangkok (TH); Kittithuch Hnuruang, Bangkok (TH); Nithipoom Durongwattana, Bangkok (TH); Amnuay Prayadsup, Bangkok (TH); Potchara Promwikorn, Bangkok (TH); Thanawee Kreethapon, Bangkok (TH); Chatchai Kongdachudomkul, Bangkok (TH)

(73) Assignee: PTT Exploration and Production Public Company Ltd., Bangkok (TH)

( * ) Notice: Subject to any disclaimer, the term of this patent is extended or adjusted under 35 U.S.C. 154(b) by 362 days.

(21) Appl. No.: 12/634,321

(22) Filed: Dec. 9, 2009

(65) Prior Publication Data

US 2011/0132593 A1 Jun. 9, 2011

(51) Int. Cl.
*E21B 43/12* (2006.01)

(52) U.S. Cl.
USPC ..... 166/372; 166/54.1; 166/313; 417/108; 417/111

(58) Field of Classification Search ..... 166/372, 166/54.1, 313; 417/108, 111
See application file for complete search history.

(56) References Cited

U.S. PATENT DOCUMENTS

| | | | | |
|---|---|---|---|---|
| 2,847,072 | A | 8/1958 | Lebourg | |
| 2,986,216 | A | 5/1961 | McCulloch | |
| 3,735,815 | A * | 5/1973 | Myers | 166/313 |
| 4,646,839 | A * | 3/1987 | Rickey | 166/335 |
| 7,832,482 | B2 * | 11/2010 | Cavender et al. | 166/302 |

* cited by examiner

*Primary Examiner* — Giovanna Wright
(74) *Attorney, Agent, or Firm* — Westerman, Hattori, Daniels & Adrian, LLP

(57) ABSTRACT

The present invention relates to a system, apparatus, and method provided to selectively produce petroleum fluid from multiple production zones well. The apparatus comprises a casing running downwardly into the well and a tubing string running in the casing. The upper and lower sealing mechanisms are provided for sealing the annular space between the casing and the tubing string, therefore, dividing the well into upper and lower production zones. Moreover, the invention comprises a bypass gaslift system provided with a tubular member, tubing string, connecting means and side pocket mandrels for injecting lifting gas into the multiple production zones well. The system and apparatus according to this invention can selectively operate to simultaneously or separately produce petroleum fluid from vertical apart multiple zones well.

16 Claims, 6 Drawing Sheets

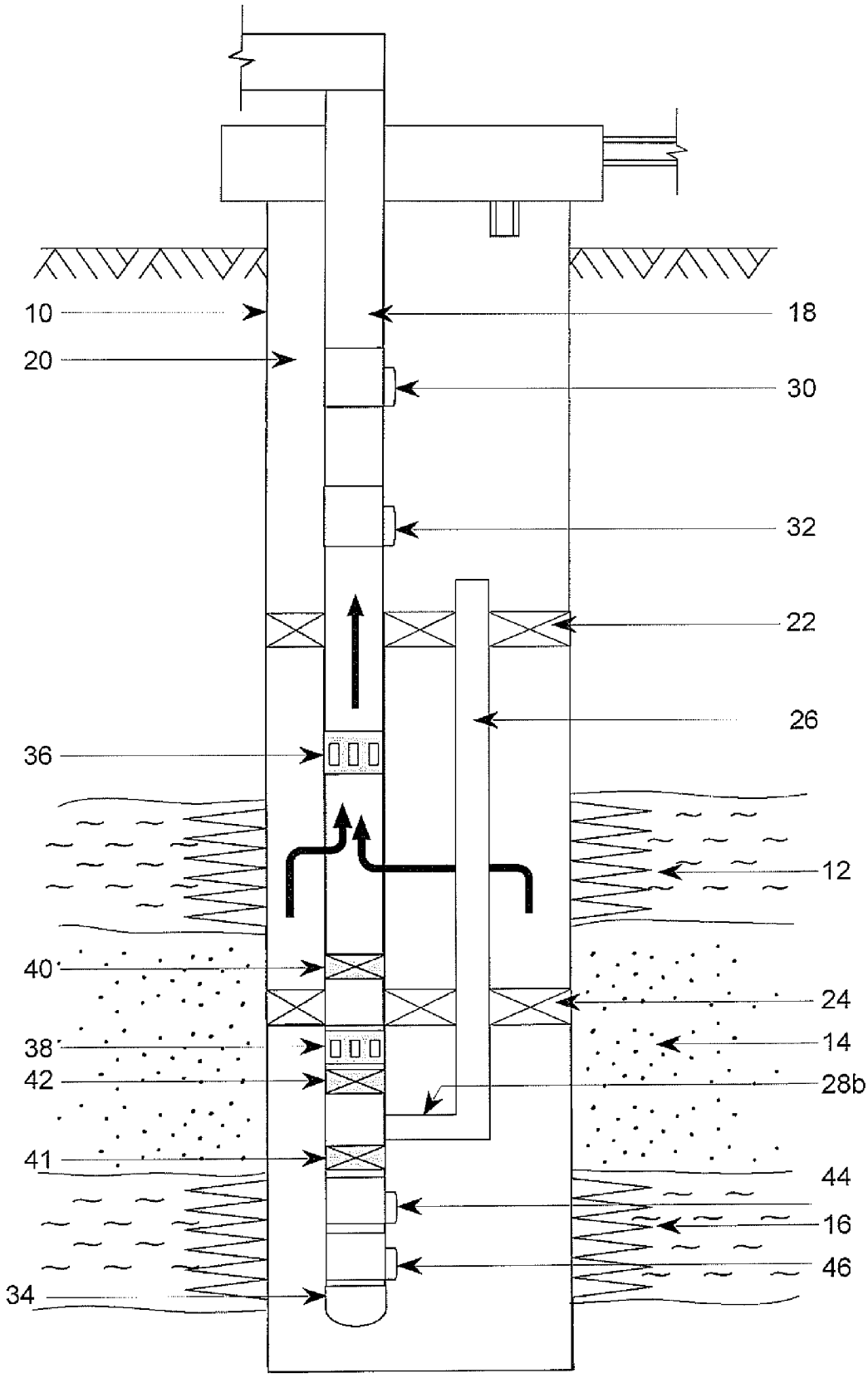
FIG. 3.1

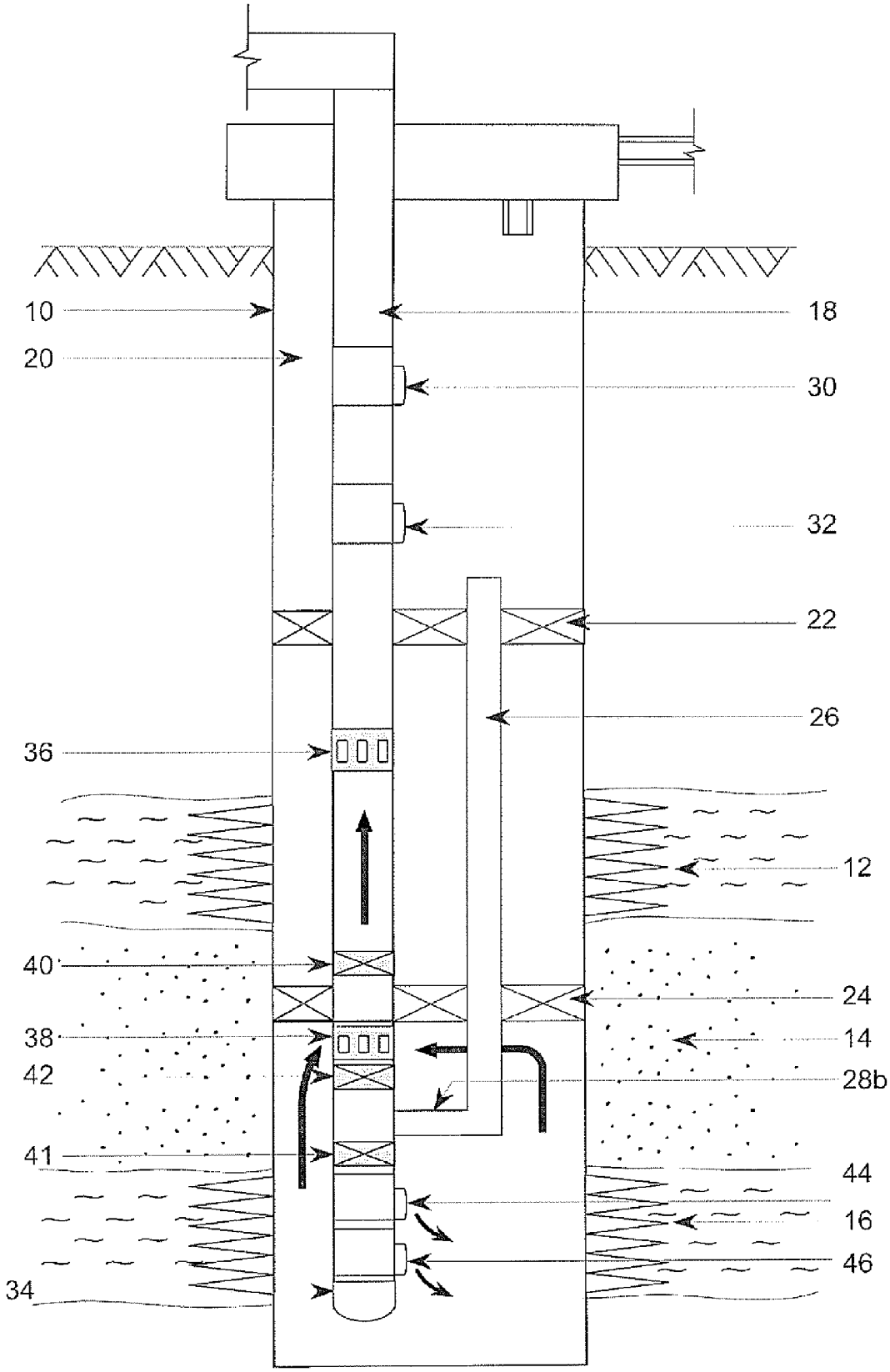
FIG. 3.2

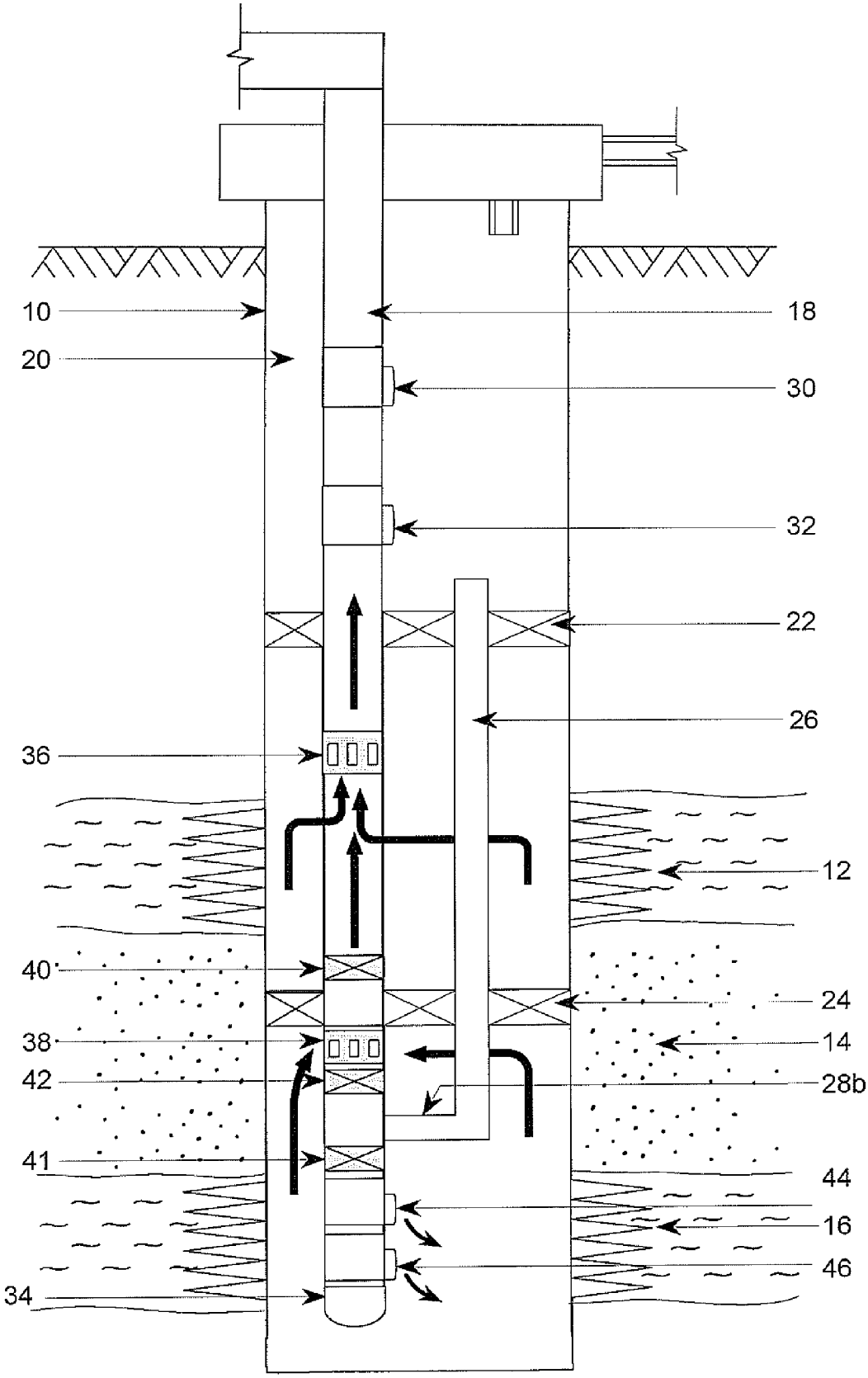
FIG. 3.3

BYPASS GASLIFT SYSTEM, APPARATUS, AND METHOD FOR PRODUCING A MULTIPLE ZONES WELL

FIELD OF THE INVENTION

The present invention relates generally to petroleum engineering in the discipline of well completion design and gaslift technique, more particularly to a gaslift system and apparatus for producing a multiple zones well by injecting gas into the production zones which help reducing hydrostatic column in order to improve well performance and productivity.

BACKGROUND OF THE INVENTION

A gaslift system is one of the artificial lift techniques using worldwide for unloading and producing fluid from perforation intervals below the packer of the pay zones. Generally, a gaslift system utilizes lifting gas supplied from surface via a casing annulus for injecting into the tubing string via gaslift valves installed in the side pocket mandrels above the packer. The lifting gas is injected into the tubing string to decrease the hydrostatic pressure of the fluid column exerting on the perforation intervals or production zones below the packer. Therefore, petroleum fluids from the said perforation intervals can flow to the wellbore and up to the surface.

However, in many petroleum fields, it is desirable to produce two different formations comminglely or separately by using the same tubing string to provide savings in pipe and drilling costs. The producing formations are often at different pressures, and one may produce gas, the other oil. The two formations, under these conditions, must of necessity be produced separately. It is also desirable to obtain such production commingle multiple zones through the tubing and through the annulus space between the casing and the tubing.

There are several patents, which disclose system and apparatus for use in petroleum fluid production of multiple zone wells, such as:

U.S. Pat. No. 2,847,072 entitled "Methods for Dual Completion of Oil and Gas Wells" discloses a method for dual completion of wells. A production packer is set in the well casing between the formations to be produced and tubing is set in the well with the lower end thereof above the upper formation. The upper and lower formations are then respectively perforated, leaving the tubing end open. A tubing extension that passes through the production packer is connected to the tubing to establish communication between the lower formation and the tubing. The two formations are effectively separated by the production packer after the tubing extension has been passed therethrough. The lower formation is produced through the tubing extension and simultaneously the upper formation is produced separately through the space between the casing and the tubing.

U.S. Pat. No. 2,986,216 entitled "Apparatus for use in Wells Completed in a Plurality of Zones" discloses an apparatus comprising a tubing string arranged in a casing with its open lower end permanently placed above the upper of the zones. A mandrel is attached to and forms the lower end of the tubing. A first packer is arranged on the lower end of the mandrel closing off the casing-tubing annulus, and a second packer having an open bore is arranged below the lower end of the mandrel to separate the upper and lower zones. The upper portion of a tubular member forms a piston slidably mounted in the mandrel and its lower end is provided with seals for placement in the open bore of the second packer. By applying fluid pressure down the tubing to the piston, the tubular member is moved from a first position in the mandrel to a second extended position whereby its lower end is sealed in the open bore of the second packer. A first flow path is provided through the tubular member and tubing in the lower zone to the earth surface and a second flow path from the upper zone through a port in the mandrel or through a second tubing string having its lower end above the upper of the plurality of zones.

Those aforementioned prior arts rely on many devices and the systems thereof are rather complex. It is therefore difficult and expensive to service in case it is necessary to remove maintenance or adjust some devices of the well system.

SUMMARY OF THE INVENTION

It is therefore an object of the present invention to provide a system and apparatus for producing multiple zones well.

More particularly, an object of this invention is to provide a gaslift system and apparatus, enabling petroleum fluid to be produced simultaneously or separately from two or more vertically spaced productive intervals by injecting gaslift below the packers.

Another object of the invention is to provide a bypass mechanism of a gaslift system and apparatus for petroleum fluid producing simultaneously or separately from multiple zones well by injecting gaslift below the packers.

Yet, another object of this invention is to provide a gaslift system, an apparatus and a bypass mechanism for producing multiple zones well, which is simple in construction, inexpensive to manufacture, durable in use, particularly capable of gaslift injection points below the packers.

The above noted objects of the invention are accomplished by disclosing a system and apparatus comprising a casing running downwardly from the ground surface into the vertically-spaced multiple production zones well and a tubing string is extended inside the casing, therefore, generating an annular space between such casing and the tubing string. A plurality of sealing mechanisms, such as packers, are arranged on the tubing string and casing to seal the annular space above each production zone. A bypass gaslift mechanism comprising of a tubular member, which acts as a bypass gaslift string, being set in the casing to parallel to the tubing string and extend downwardly from above the uppermost sealing mechanism to pass through each sealing mechanisms then stop near the lowest production zone. The connecting means is provided as passageways for connecting the tubular member to the tubing string at different depths near the production zones. Further, the gas injection mechanism, in one embodiment may be a side pocket mandrel having valve inside it, are assembled to the tubing string below the connecting means for injecting lifting gas to the production zone(s), and an opening/closing mechanism or a port, i.e. sliding side door, are assembled to the tubing string above the production zone in order to allow unloaded petroleum fluid to enter the tubing and flow upwardly to the ground surface. The apparatus of this invention may comprises at least one gas injection system, e.g. gas lift valve and side pocket mandrel, installed to the tubing string above the uppermost sealing mechanism for injecting lifting gas from the annular space into the tubing string. Also, one or more nipples may be installed to the tubing string to control lifting gas rate and direction for assisting petroleum unloading if need.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein:

FIG. 3.1 is a cross-sectional view of the gaslift system and apparatus according to an embodiment of FIG. 1 showing petroleum fluid unloaded path when operating for separately producing petroleum fluid from the upper production zone.

FIG. 3.2 is a cross-sectional view of the gaslift system and apparatus according to an embodiment of FIG. 1 showing petroleum fluid unloaded path when operating for separately producing petroleum fluid from the lower production zone.

FIG. 3.3 is a cross-sectional view of the gaslift system and apparatus according to an embodiment of FIG. 1 showing petroleum fluid unloaded path when operating for simultaneously producing petroleum fluid from the upper and lower production zones.

DETAILED DESCRIPTION OF THE PREFERRED EMBODIMENTS

Figure 1:
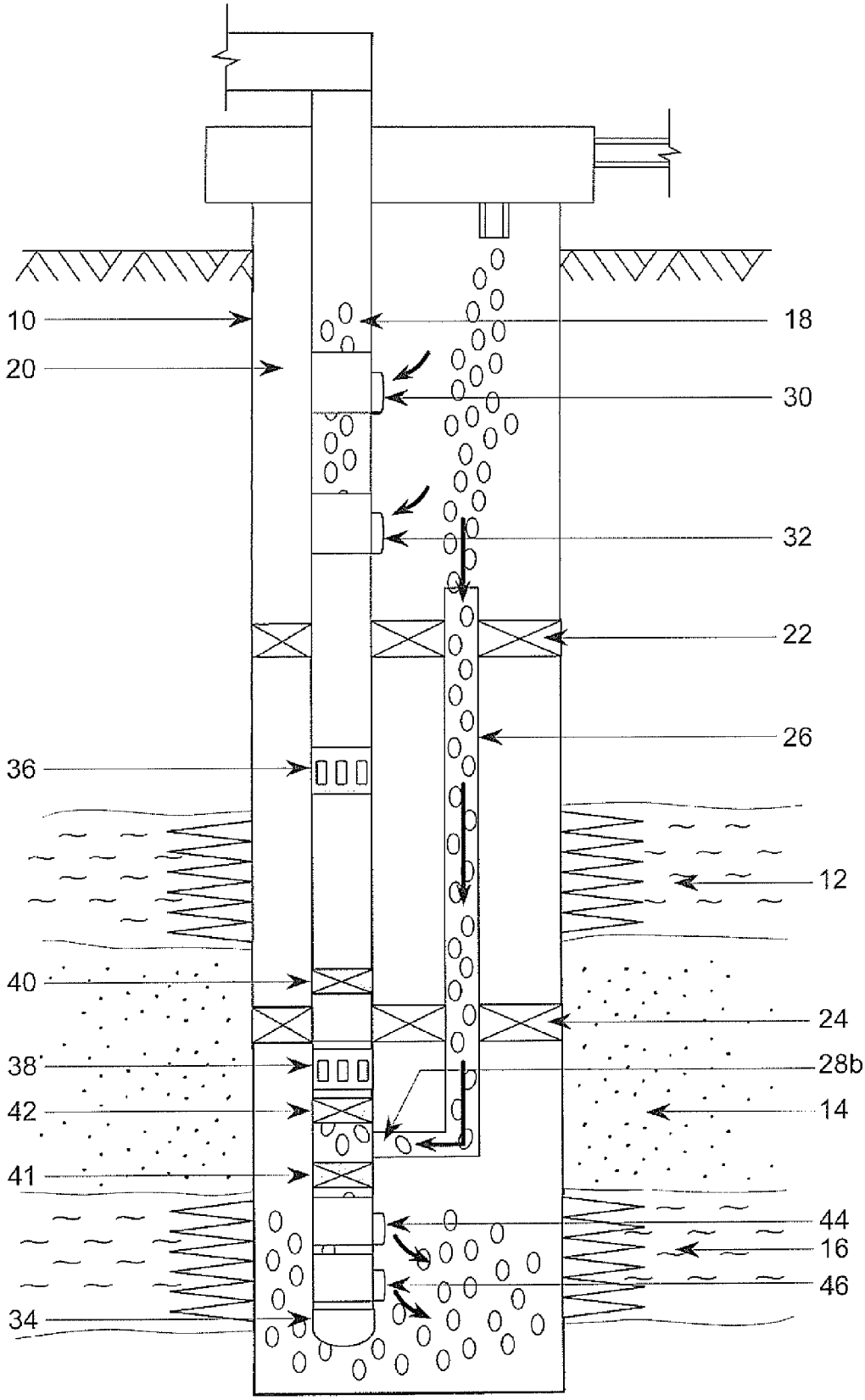
FIG. 1 is a cross-sectional view of the gaslift system and apparatus according to an embodiment of the present invention showing gaslift supplying path when the gaslift system and apparatus is designed to enable selectively producing petroleum fluid from the upper and lower production zones or simultaneously producing fluid from the upper and lower zones.

According to FIG. 1 to 4, a gaslift system and apparatus of the present invention typically comprises a casing 10 running from the ground surface to down hole and penetrating a plurality of intervals 12, 16 of which intervals 12 and 16 are vertically-spaced upper and lower petroleum fluid production zones respectively. A tubing string 18 is extended downwardly into the casing 10 to a point below the upper production zone 12 and adjacent the lower production zone 16, and therefore forming an annular space 20 designated an area between the casing 10 and the tubing string 18. An upper sealing mechanism 22, such as a dual port packer, is arranged on the tubing string 18 above the upper production zone 12 for closing the annular space 20, and a lower sealing mechanism 24, also a dual port packer, is arranged on the tubing string 18 between the upper and the lower production zones 12, 16, thus serves to separate such two zones 12, 16. The upper and lower sealing mechanisms 22, 24 are provided with an open bore for receiving a tubular member 26 which acts as a bypass gaslift string. The tubular member 26 is assembled to parallel with the tubing string 18 and arranged to have its upper end being in the annular space 20 above the upper sealing mechanism 22 and extending downwardly therefrom to pass through the upper zone 12 and the lower sealing mechanism 24 into an area approaching to the lower production zone 16. The tubular member 26 also comprises one or more connecting means (28*a* or 28*b*) provided for connecting the tubular member 26 to the tubing string 18. The said connecting means (28*a* or 28*b*), in a preferred embodiment, may be a nipple mandrel.

Further, the gaslift apparatus may comprises at least one gaslift valve and side pocket mandrels (30 or 32) being installed in the tubing string 18 at various elevations above the upper sealing mechanism 22 for injecting gas from the annular space 20 into the tubing string 18 when unloading petroleum fluid, and a bull plug 34 is installed at bottom end of the tubing string 18 for sealing gas pressure and preventing maintenance tools passing outside the well bore.

Next, the particular embodiment of the gaslift apparatus of this invention incorporating with a bypass mechanism for simultaneously or separately injecting gas into the upper and/or lower production zones 12, 16 will be described.

Referring now particularly to FIG. 1 and FIG. 3.1 to 3.3 illustrating one preferably embodiment of the gaslift system and apparatus of this invention, the bypass gaslift system according to this embodiment is primary designed for separately unloading petroleum fluid from the upper and lower production zones 12, 16. Moreover, it is able to apply the apparatus and system of this embodiment to simultaneously produce petroleum fluid from the production zones 12, 16 if need. The bypass gaslift system of this embodiment comprises the tubular member 26 set in the upper and lower sealing mechanism 22, 24 and connected with the tubing string 18 via the lower connecting means 28*b*. An upper sliding side door 36 is coupled to the tubing string 18 between the upper sealing mechanism 22 and the upper production zone 12, while a lower sliding side door 38 is coupled to the tubing string 18 between the lower sealing mechanism 24 and the lower production zone 16. An upper nipple 40 is coupled to the tubing string 18 between the upper production zone 12 and the lower sealing mechanism 24, while a middle nipple 42 is coupled to the tubing string 18 between the lower sliding side door 38 and the lower production zone 16. A lower nipple 41 is coupled to the tubing 18 between the lower connecting means 28*b* and side pocket mandrel 44 for such reasons e.g. isolate lower zone 16 from producing upper zone 12 separately by injecting lifting gas through the lower connecting means 28*b* up to the lower sliding side door 38, at which flow control device is installed inside the sliding side door 38 to control gaslift flow rate. Furthermore, one or more of the side pocket mandrels 44, 46 including gas injection valve inside it is installed below the connecting means 28*b* for injecting gas to the wellbore proximate the lower production zone 16.

With the system and apparatuses described above incorporated FIG. 1, selectively production of petroleum fluid from the production zones 12,16 can be accomplished by injecting gas into the petroleum fluid in the production zones 12, 16, thus reducing petroleum fluid density and allowing it to flow upwardly to the surface, whereby the arrows in FIG. 1 are provided for indicated the gas supplying path and the arrows in FIG. 3.1 to 3.3 are for indicated petroleum fluid unloaded path when operating in various productions.

According to FIG. 1 showing the gas supplying path when producing petroleum fluid, the lifting gas is injected into the annular space 20 above the upper sealing mechanism 22, then forced to enter the tubing string 18 via the side pocket mandrels 30, 32. Meanwhile, the lifting gas being in the annular space 20 will enter the tubular member 26 to pass through the upper and lower sealing mechanism 22, 24 then enter the tubing string 18 via the lower connecting means 28*b*. The lifting gas is then controllable to flow upwardly by utilizing a plug being set in the lower nipple 41 to force the gaslift to flow though a flow control device installed inside the lower sliding side door 38 in close position in order to separately produce petroleum fluid from the upper zone 12. On the other hand, the lifting gas may be controlled to enter the tubing string 18 via the connecting means 28*b*, then flow downwardly before being injected adjacent to the lower production zone 16 by the operation of the side pocket mandrels 44, 46 when need to separately produce petroleum fluid from the lower zone 16. Also, simultaneously production from the upper and lower zones 12, 16 can be operated by controlling the lifting gas to flow upwardly and downwardly to unload petroleum fluid being in the upper and lower zones 12, 16 in the same time.

Referring to FIG. 3.1 showing petroleum fluid unloaded path when the upper production zone 12 is decided producing separately, petroleum fluid unloaded from the upper zone 12 enters the tubing string 18 via the upper sliding side door 36 and then flows upwardly along the tubing string 18 to the ground surface. Vice versa, as seen in FIG. 3.2, when the lower production zone 16 is decided producing separately, unloaded fluid from the lower zone 16 enters the tubing string 18 though the lower sliding side door 38, then flows upwardly along the tubing string 18 to the ground surface.

Furthermore, incorporating with FIG. 3.3, simultaneously production of the upper and lower zones 12,16 can be accomplished by incorporating fluid unloaded paths as mentioned above wherein unloaded petroleum fluid from the upper production zone 12 enters the tubing string 18 via the upper sliding side door 36 being in the open position, meanwhile, unloaded fluid from the lower zone 16 enters the tubing string 18 though the lower sliding side door 38, then flows upwardly to commingle with unloaded fluid from the upper zone 12 before flowing upwardly to the ground surface.

According to the system and apparatuses described above, the petroleum fluid from the upper and lower zones 12, 16 can be unloaded separately, the fluid in the upper zone 12 will be lifted by utilizing the lifting gas being in the tubing string 18 above the lower sealing mechanism 24, while the lower zone 16 production can be accomplished by the lifting gas flows to the lower zone by utilizing the bypass gaslift system comprising of the tubular member 26, the connecting means 28*b* and the side pocket mandrels 44, 46. Moreover, as aforementioned, this embodiment, FIG. 1 and FIG. 3.1 to 3.3, is also applicable and allow producing simultaneously from the upper and lower production zones 12,16 if need for some certain well conditions.

Figure 2:
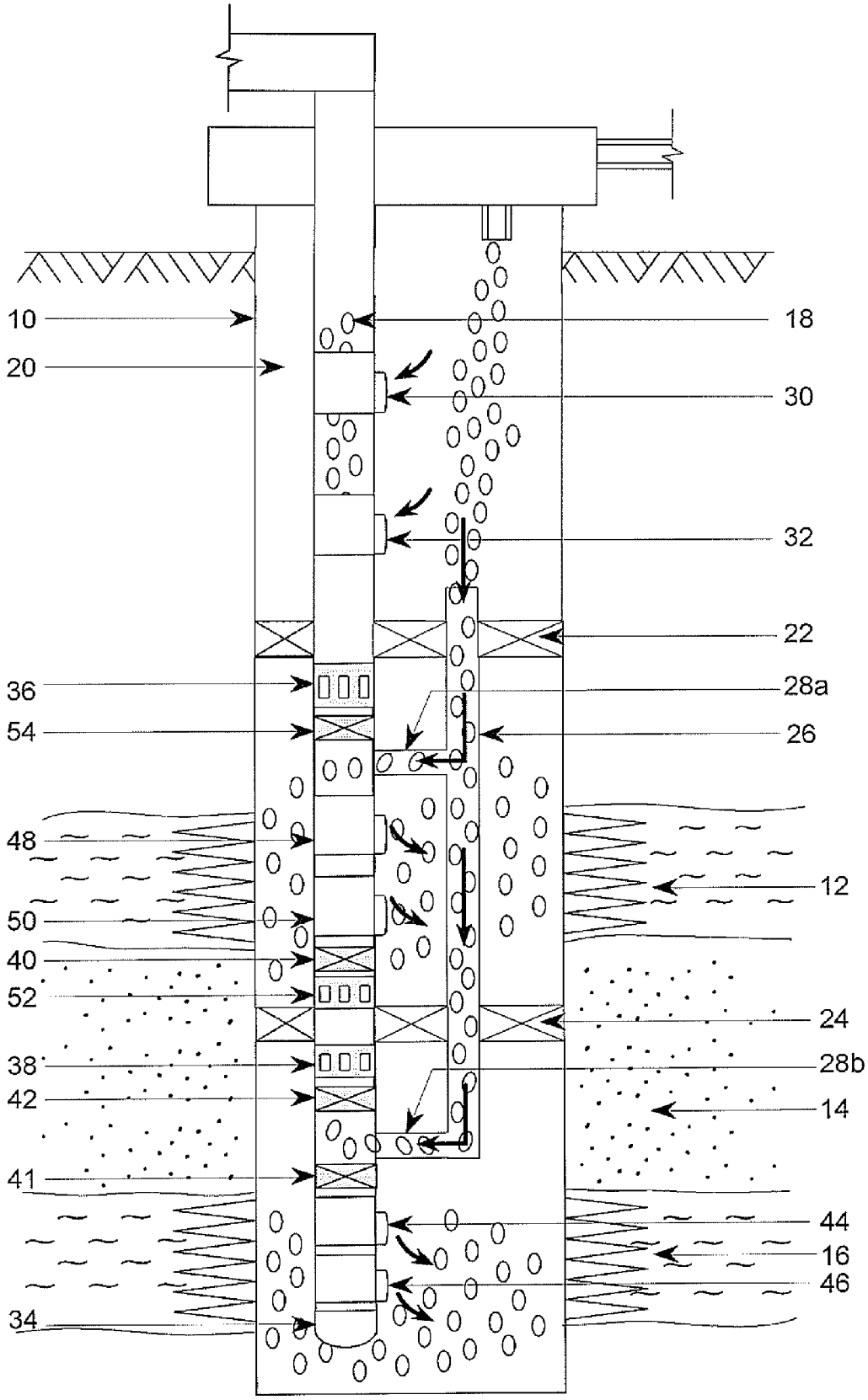
FIG. 2 is a cross-sectional view of the gaslift system and apparatus according to an embodiment of the present invention showing gaslift supplying path when the gaslift system and apparatus is designed for simultaneously producing petroleum fluid from the upper and lower production zones.
Figure 4:
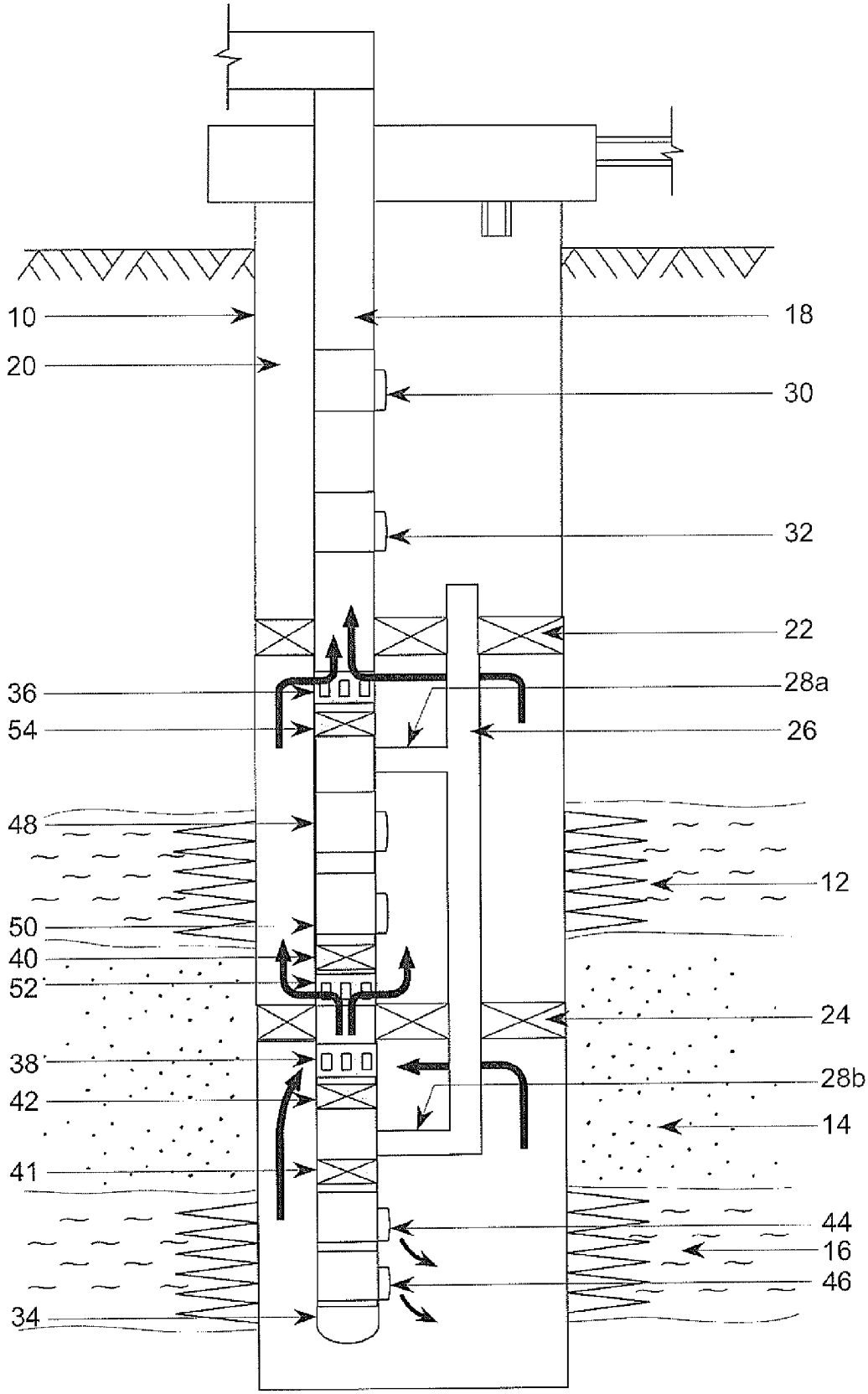
FIG. 4 is a cross-sectional view of the gaslift system and apparatus according to an embodiment of FIG. 2 showing petroleum fluid unloaded path when operating for simultaneously producing petroleum fluid from the upper and lower production zones.

Another preferred embodiment of the gaslift system and apparatus is shown in FIGS. 2 and 4. In such embodiment, the lifting gas will be injected continuously to the upper and lower production zones 12, 16, the petroleum production therefore can be accomplished simultaneously both upper and lower zones 12, 16. The bypass gaslift system of this embodiment comprises the tubular member 26 incorporated with an upper connecting means 28*a* and the lower connecting means 28*b*, which also utilize the nipple mandrels provided for allowing lifting gas to flow into the tubing string 18. This embodiment further comprises side pocket mandrels (48 and 50) assembled to the tubing string 18 below the upper connecting means 28*a* for injecting lifting gas to the upper production zone 12. Moreover, a sliding side door 52 is provided between the middle nipple 40 and the lower sealing mechanism 24, and an upper nipple 54 is provided between the upper sliding side door 36 and the upper connecting means 28*a*.

Referring now to FIG. 2 showing the gas supplying path when operating to produce petroleum fluid using the apparatus of the above-mentioned embodiment, the lifting gas injected into the annular space 20 will flow into the tubular member 26 then pass through the upper and lower sealing mechanisms (22 and 24) and enter the tubing string 18 via the upper connecting means 28*a* and lower connecting means 28*b*, respectively. The lifting gas is then injected into the annular space 20 adjacent to the upper production zone 12 by utilizing the side pocket mandrels 48 and 50, and is injected into the annular space 20 adjacent to the lower production zone 16 by utilizing the side pocket mandrels 44 and 46.

Referring more to FIG. 4 showing the petroleum fluid unloading path when operating to simultaneously produce petroleum fluid from both production zones, petroleum fluid being in the upper production zone 12 is unloaded to enter the tubing string 18 through the sliding side door 36 then unloaded upwardly along the tubing string 18 to the ground surface. In the meantime, petroleum fluid being in the lower production zone 16 is unloaded to enter the tubing string 18 through the sliding side door 38. The unloaded petroleum from the lower zone 16 is then forced to exit the tubing string 18 via the sliding side door 52 in open position and comingle with the unloaded petroleum from the upper zone 12 before forced to enter the tubing string 18 again via the sliding side door 36 and unloaded upwardly to the earth surface.

As described above, the such claims of this patent application shall cover the entire system, apparatus, methods for producing a multiple zones well by injecting gaslift down below the upper sealing mechanism which set above the top perforation interval or upper production zone which cover producing a well separately, or simultaneously, or both as explained above incorporating with FIG. 1, FIG. 2, FIG. 3.1-3.3, and FIG. 4. The gaslift may be injected at any depths depend on specific well completion design at various well conditions and situations. The production zones may separate more than 2 according to well completion engineering design at which each zone may consist of similar apparatus illustrated in FIG. 1, FIG. 2, FIG. 3.1-3.3, and FIG. 4. However, the principle of producing method shall be the same.

What is claimed is:

1. An apparatus for producing petroleum fluid from a multiple zones well, the apparatus comprising:

a casing running downwardly from the ground surface into the vertically-spaced multiple production zones;

a tubing string arranged within the casing whereby an annular space is formed between the said casing and tubing string;

at least one sealing mechanism arranged on the tubing string and casing to seal the annular space above the production zones; and a tubular member arranged in the at least one sealing mechanism parallel to the tubing string and extends downwardly from above the at least one sealing mechanism then ends near the production zones, wherein the tubular member comprises at least one connecting means provided as passageway for connecting the tubular member to the tubing string at a depth below the sealing mechanism, at least one gas injection mechanism assembled to the tubing string below the at least one connecting means for injecting lifting gas to the production zones, and at least one opening/closing mechanism or a port installed to the tubing string above the production zones to allow unloaded petroleum fluid to enter the tubing string.

2. The apparatus according to claim 1, further comprising at least one gas injection mechanism installed above the at least one sealing mechanism for injecting lifting gas into the tubing string at a depth above an uppermost sealing mechanism.

3. The apparatus according to claim 1 or 2, further comprising at least one nipple installed with flow control device to the tubing string to control lifting gas flow rate.

4. The apparatus according to claim 1, wherein the at least one sealing mechanism is a dual-port packer in which one port is for adapting with the tubing string and another port is for adapting with the tubular member.

5. The apparatus according to claim 1, wherein the at least one opening/closing mechanism or a port is a sliding side door.

6. An apparatus for producing petroleum fluid from a multiple zones well, the apparatus separately produces petroleum fluid from two vertically-spaced production zones and comprises:

a casing running downwardly from the ground surface into the vertically-spaced upper and lower production zones;

a tubing string arranged in the casing whereby an annular space is formed between the said casing and tubing string;

a sealing mechanism comprising an upper sealing mechanism and a lower sealing mechanism arranged on the tubing string and casing to seal the annular space above the upper and lower production zones respectively; and a tubular member arranged in the upper and lower sealing mechanisms parallel to the tubing string and extends downwardly from above the upper sealing mechanism then ends near the lower production zone, wherein the tubular member comprises at least one connecting means provided as passageway for connecting the tubular member to the tubing string at a depth below the lower sealing mechanism, at least one gas injection mechanism assembled to the tubing string below the at least one connecting means for injecting lifting gas to the lower production zone, at least one gas injection mechanism assembled to the tubing string above the upper sealing mechanism for injecting lifting gas into the tubing string, and at least one opening/closing mechanism or a port intalled to the tubing string above the lower production zone to allow unloaded petroleum fluid to enter the tubing string.

7. The apparatus according to claim 6, further comprising at least one nipple with flow control device installed to the tubing string to control lifting gas flow rate.

8. The apparatus according to claim 6 or 7 wherein the sealing mechanism is a dual-port packer in which one port is for adapting with the tubing string and another port is for adapting with the tubular member.

9. The apparatus according to claim 6, wherein the at least one opening/closing mechanism or a port is a sliding side door.

10. An apparatus for producing petroleum fluid from a multiple zones well, the apparatus simultaneously produces petroleum fluid from two vertically-spaced production zones and comprises:

a casing running downwardly from the ground surface into the vertically-spaced upper and lower production zones;

a tubing string arranged in the casing whereby an annular space is formed between the said casing and tubing string;

a sealing mechanism comprising an upper sealing mechanism and a lower sealing mechanism arranged on the tubing string and casing to seal the annular space above the upper and lower production zones respectively; and a tubular member arranged in the upper and lower sealing mechanisms parallel to the tubing string and extends downwardly from above the upper sealing mechanism then ends near the lower production zone, wherein the tubular member comprises upper and lower connecting means provided as passageways for connecting the tubular member to the tubing string at the depths between the upper and lower sealing mechanisms and below the lower sealing mechanism respectively, at least one gas injection mechanism assembled to the tubing string below the upper connecting means and below the lower connecting means for injecting lifting gas to the upper and lower production zones respectively, and opening/closing mechanisms or ports intalled to the tubing string above the upper production zone and lower production zone to allow the unloaded petroleum fluid to enter the tubing string.

11. The apparatus according to claim 10, further comprising at least one gas injection mechanism installed above the upper sealing mechanism for injecting lifting gas into the tubing string at a depth above the upper sealing mechanism.

12. The apparatus according to claim 10, further comprising:

at least one nipple with flow control device installed to the tubing string to control lifting gas flow rate.

13. The apparatus according to claim 10, wherein the sealing mechanism is a dual-port packer in which one port is for adapting with the tubing string and another port is for adapting with the tubular member.

14. A bypass gaslift mechanism of an apparatus for producing petroleum fluid from a multiple zones well, which is comprised of a casing running downwardly from the ground surface into the vertically-spaced multiple production zones, a tubing string arranged in the casing whereby an annular space is formed between the said casing and tubing string and at least one sealing mechanism arranged on the tubing string and casing to seal the annular space above the production zones, the bypass gaslift mechanism comprising:

a tubular member arranged in the sealing mechanism parallel to the tubing string and extends downwardly from above the sealing mechanism and ends near the production zones;

at least one connecting means provided as passageway for connecting the tubular member to the tubing string at a depth below the sealing mechanism;

at least one gas injection mechanism assembled to the tubing string below the at least one connecting means for injecting lifting gas to the production zones; and at least one opening/closing mechanism or a port installed to the tubing string above the production zones to allow unloaded petroleum fluid to enter the tubing string.

15. The bypass gaslift mechanism according to claim 14, further comprising at least one nipple with flow control device installed to the tubing string to control lifting gas flow rate.

16. The bypass gaslift mechanism according to claim 14 or 15, wherein the at least one opening/closing mechanism or a port is a sliding side door.

* * * * *